US010051919B2

(12) United States Patent
Leary et al.

(10) Patent No.: US 10,051,919 B2
(45) Date of Patent: Aug. 21, 2018

(54) ARTICLE OF FOOTWEAR HAVING A BLADDER

(71) Applicant: REEBOK INTERNATIONAL LIMITED, London (GB)

(72) Inventors: Kevin Leary, Dedham, MA (US); Matthew J. Costa, Canton, MA (US); Dan Hobson, Waltham, MA (US); Toby Birkinhead, Hertfordshire (GB); John Greenhalgh, Foxboro, MA (US); Thomas Piacentini, Waltham, MA (US)

(73) Assignee: REEBOK INTERNATIONAL LIMITED, London (GB)

( * ) Notice: Subject to any disclaimer, the term of this patent is extended or adjusted under 35 U.S.C. 154(b) by 29 days.

(21) Appl. No.: 15/184,718

(22) Filed: Jun. 16, 2016

(65) Prior Publication Data

US 2017/0360155 A1 Dec. 21, 2017

(51) Int. Cl.

| | |
|---|---|
| ***A43B 23/02*** | (2006.01) |
| ***A43B 23/08*** | (2006.01) |
| ***A43B 5/06*** | (2006.01) |

(52) U.S. Cl.

CPC ..... *A43B 23/029* (2013.01); *A43B 5/06* (2013.01); *A43B 23/024* (2013.01); *A43B 23/026* (2013.01); *A43B 23/0235* (2013.01); *A43B 23/081* (2013.01)

(58) Field of Classification Search

CPC ..... A43B 23/026; A43B 23/029; A43B 23/26
USPC ..... 36/3 R, 3 A, 29, 45, 54
See application file for complete search history.

(56) References Cited

U.S. PATENT DOCUMENTS

| | | | | |
|---|---|---|---|---|
| 5,113,599 | A * | 5/1992 | Cohen | A43B 17/035 36/114 |
| 5,343,638 | A * | 9/1994 | Legassie | A43B 3/0005 36/28 |
| 5,435,230 | A | 7/1995 | Phillips | |
| 5,806,208 | A * | 9/1998 | French | A43B 7/02 36/28 |
| 6,557,274 | B2 * | 5/2003 | Litchfield | A43B 1/0072 36/29 |
| 7,337,560 | B2 * | 3/2008 | Marvin | A43B 13/20 36/29 |
| 7,340,851 | B2 * | 3/2008 | Litchfield | A43B 13/20 36/29 |
| 7,513,067 | B2 * | 4/2009 | Marvin | A43B 1/0072 36/29 |
| 7,622,014 | B2 | 11/2009 | Millette et al. | |
| 7,721,465 | B2 * | 5/2010 | Marvin | A43B 13/20 36/28 |
| 7,735,241 | B2 * | 6/2010 | Marvin | A43B 13/20 36/29 |

(Continued)

*Primary Examiner* — Marie Bays
(74) *Attorney, Agent, or Firm* — Sterne, Kessler, Goldstein & Fox P.L.L.C.

(57) ABSTRACT

An upper comprising a flexible layer configured to receive a foot, a bladder coupled to an outer surface of the flexible layer, and an inflation mechanism operatively coupled to the bladder for inflating the bladder such that the flexible layer is drawn toward the foot. The bladder extends from a lateral side in a heel region across a throat region to a medial side in the heel region. The bladder comprises a plurality of fluidly connected segments, each segment forming an angle with an adjacent segment.

21 Claims, 15 Drawing Sheets

(56) References Cited

U.S. PATENT DOCUMENTS

| | | | | |
|---|---|---|---|---|
| 8,151,489 | B2 * | 4/2012 | Marvin | A43B 13/20 36/29 |
| 8,540,838 | B2 | 9/2013 | Millette et al. | |
| 8,572,786 | B2 | 11/2013 | Davis et al. | |
| 8,677,652 | B2 * | 3/2014 | Marvin | A43B 13/20 36/45 |
| 9,101,179 | B2 * | 8/2015 | Marvin | A43B 9/12 |
| 2001/0032399 | A1 * | 10/2001 | Litchfield | A43B 1/0072 36/88 |
| 2006/0130370 | A1 * | 6/2006 | Marvin | A43B 1/0072 36/93 |
| 2008/0250668 | A1 * | 10/2008 | Marvin | A43B 9/12 36/54 |
| 2014/0053968 | A1 | 2/2014 | Millette et al. | |
| 2014/0059890 | A1 | 3/2014 | Davis et al. | |
| 2014/0283410 | A1 * | 9/2014 | Marvin | A43B 23/0235 36/45 |

* cited by examiner

ARTICLE OF FOOTWEAR HAVING A BLADDER

BACKGROUND OF THE INVENTION

Field of the Invention

Embodiments of the present invention relate generally to articles of footwear; and more specifically to an upper containing a bladder, and articles of footwear that include the upper.

Background Art

Throughout the course of an average day, the feet and legs of an individual are subjected to substantial impact forces. Although the human foot possesses natural cushioning and rebounding characteristics, the foot alone is incapable of effectively overcoming many of the forces encountered during every-day activity. Unless an individual is wearing shoes that fit properly and provide proper cushioning and support, the soreness and fatigue associated with every-day activity is more acute, and its onset accelerated. The discomfort for the wearer that results may diminish the incentive for further activity. Equally important, inadequately cushioned and improperly fit footwear can lead to injuries such as blisters; muscle, tendon and ligament damage; and bone stress fractures. Improper footwear can also lead to other ailments, including back pain.

Proper footwear should complement the natural functionality of the foot, in part, by incorporating a sole (typically including an outsole, midsole, and insole) and/or an upper which secures the article of footwear to a wearer's foot with the appropriate fit and cushioning. Properly securing the article of footwear to the wearer's foot can reduce the risk of injury and discomfort caused by the wearer's foot moving relative to the upper. Therefore, a continuing need exists for innovations in uppers that secure the article of footwear to the wearer's foot with the appropriate fit and cushioning.

BRIEF SUMMARY OF THE INVENTION

Uppers and articles of footwear having a bladder are disclosed. In some embodiments, an upper includes a flexible layer configured to receive a foot, a bladder coupled to an outer surface of the flexible layer, and an inflation mechanism operatively coupled to the bladder for inflating the bladder such that the flexible layer is drawn toward the foot. In some embodiments, the bladder extends from a lateral side in a heel region across a throat region to a medial side in the heel region. In some embodiments, the bladder includes a plurality of fluidly connected segments, each segment forming an angle with an adjacent segment.

In some embodiments, each of the plurality of fluidly connected segments extends away from a collar of the upper. In some embodiments, the angle is less than ninety degrees. In some embodiments, the angle is less than forty-five degrees.

In some embodiments, the upper includes a joint fluidly connecting each segment, wherein an inner side of the joint is circular. In some embodiments, the upper includes a joint fluidly connecting each segment, wherein an inner side of the joint approximates a square. In some embodiments, two adjacent segments form a V shape.

In some embodiments, the upper includes a polyurethane coating overlaying the bladder and forming a portion of an exterior of the upper. In some embodiments, the bladder is coupled to the outer surface of the flexible layer by sewing. In some embodiments, the bladder is coupled to the outer surface of the flexible layer by hot melting. In some embodiments, the flexible layer comprises multiple layers. In some embodiments, the upper includes a release mechanism.

In some embodiments, an article of footwear includes a sole, an upper attached to the sole and configured to receive a wearer's foot, a bladder disposed on an outermost surface of the upper, and an inflation mechanism operatively coupled to the bladder. In some embodiments, the bladder forms a zig-zag pattern extending from a heel region on a lateral side across a throat region to the heel region on a medial side. In some embodiments, in an inflated state, air disposed in a portion of the bladder closer to the sole causes a portion of the bladder closer to a collar of the upper to tighten around the wearer's foot.

In some embodiments, in an inflated state, air disposed in the portion of the bladder closer to the collar of the upper causes the portion of the bladder closer to the sole to tighten around the wearer's foot. In some embodiments, the inflation mechanism is disposed at a top of the throat region. In some embodiments, the article of footwear includes a release mechanism. In some embodiments, the article of footwear includes a mesh layer partially surrounding the bladder.

In some embodiments, the bladder forms a conduit. In some embodiments, the top portion of the bladder is disposed at a collar of the upper. In some embodiments, the zig-zag pattern comprises a vertical zig-zag. In some embodiments, an inner side of a curved portion of the zig-zag pattern is circular. In some embodiments, the portion of the bladder closer to the sole is disposed adjacent to the sole and extends horizontally along the sole.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
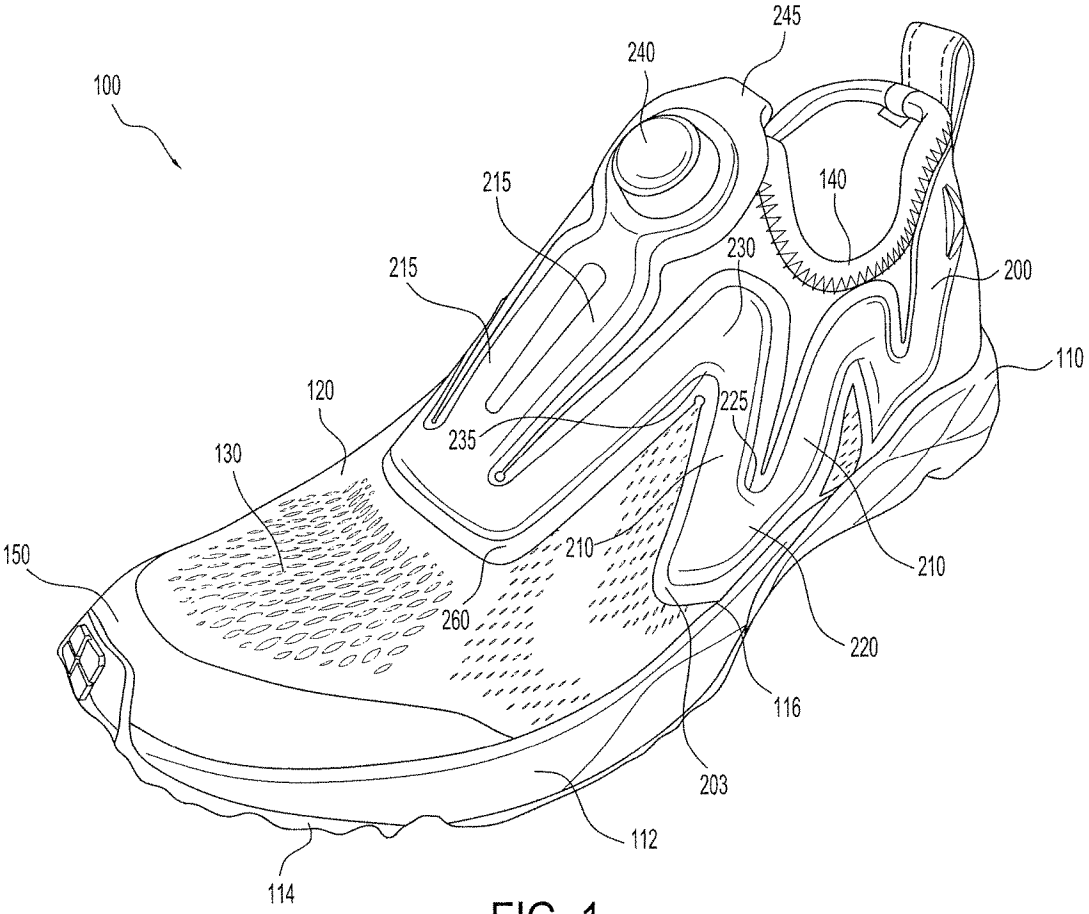
FIG. 1 shows a perspective view of an article of footwear according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide an article of footwear with an upper that secures the article footwear to a wearer's foot with the proper and desired fit and cushioning. In particular, inflatable bladders may be used to not only fill in gaps between an upper and a wearer's foot, but also to cinch down the upper to ensure the wearer's foot is securely fitted within the upper. Thus, the inflatable bladder may reduce the risk of injury and/or discomfort caused by a wearer's foot moving relative to the upper. Embodiments of the present invention provide an article of footwear with an inflatable bladder that allows a wearer's foot to be easily inserted into the upper and then securely fitted within the upper upon inflation of the bladder. Thus, embodiments of the present invention may help increase the comfort of the wearer's foot and/or may help reduce the risk of various injuries to the foot.

For example, according to some embodiments, the article of footwear includes an upper with an inflation system. The inflation system comprises an inflatable bladder disposed on an outermost surface of the upper. An inflation mechanism and a release mechanism allow the wearer to inflate and deflate the inflatable bladder and thus securely fit the upper to the wearer's foot. The inflatable bladder may extend from a heel region on a lateral side across the throat region to the heel region on a medial side. Further, the inflatable bladder may form a zig-zag pattern (e.g., extending away from and towards a collar of the upper). In this configuration, the bladder cinches down on the wearer's foot when inflated, thereby securely fitting the upper to the wearer's foot.

Athletic shoe 100, as illustrated, for example, in FIGS. 1-6, is an embodiment of the article of footwear. Athletic shoe 100 may comprise a running shoe, a training shoe, a basketball shoe, or any other suitable athletic shoe. Although athletic shoe 100 is primarily described, other embodiments envision the present invention utilized in other types of footwear, including, but not limited to, non-athletic footwear, and sandals. Moreover, although FIGS. 1-6 depict a shoe for use on the left foot of a wearer, the principles of the present invention are equally applicable to shoes intended for use on the right foot. Athletic shoe 100 comprises both a sole 110 and an upper 120.

In some embodiments, sole 110 suitable for athletic shoe 100 may have various characteristics, as described below. In some embodiments, sole 110 includes one or more of an outsole 114, a midsole 112, and an insole (not shown). According to some embodiments, for example, sole 110 includes all three of outsole 114, midsole 112, and the insole.

Sole 110 may be constructed of any materials common in various applications of shoes. The materials used for the outsole 114, midsole 112, and the insole may be different from each other or the same. In some embodiments, for example, the outsole 114 is preferably made with a material that is abrasion resistant, such as rubber. In one embodiment, midsole 112 is made with a foam material, such as ethyl vinyl acetate (EVA) foam or foamed polyurethane.

Although exemplary embodiments have been described above, sole 110 may be any sole suitable for athletic shoe 100. Furthermore, other soles may be appropriate within the scope of the present invention for other types of shoes.

In some embodiments, upper 120 suitable for athletic shoe 100 may have various characteristics, as described below. Upper 120 may be attached to sole 110 by stitching, an adhesive, or other suitable fastening means. In some embodiments, upper 120 includes one or more flexible layers 130.

In some embodiments, flexible layer 130 is configured to receive a wearer's foot. In some embodiments, flexible layer 130 completely surrounds the wearer's foot. For example, in one embodiment, flexible layer 130 may be a bootie. In other embodiments, flexible layer 130 covers a top portion and/or side portions of the wearer's foot and is secured to sole 110 disposed underneath the wearer's foot. Flexible layer 130 may be secured to sole 110 by stitching, an adhesive, or other suitable fastening means. In some embodiments, all or portions of the flexible layer 130 are the innermost layer of upper 120. In some embodiments, portions of flexible layer 130 form the outermost layer of portions of upper 120. In some embodiments, one flexible layer 130 is the innermost layer of upper 120 and portions of another flexible layer 130 form the outermost layer of portions of upper 120.

Flexible layer 130 may be made from a flexible material. In some embodiments, flexible layer 130 is made from a stretchable textile with multi-dimensional stretch. In some embodiments, flexible layer 130 is made from Lycra®. In some embodiments, flexible layer 130 is made of a mesh material.

In some embodiments, each flexible layer 130 may be made from the same material. In some embodiments, one flexible layer 130 may be made from a different material than another flexible layer 130. In some embodiments, each flexible layer 130 has the same properties. In some embodiments, one flexible layer 130 may have different properties than another flexible layer 130 (e.g., flexible layer 130 closest to the wearer's foot may have a finer mesh than flexible layer 130 visible from outside of the upper 120). In some embodiments, flexible layer 130 may have different properties in different regions of upper 120 (e.g., finer mesh in a heel region than in a vamp region).

In some embodiments, upper 120 includes a collar 140 that defines an opening for receiving the wearer's foot within upper 120. In some embodiments, upper 120 includes a toe cap 150 to provide additional support and/or protection to the wearer's foot in the toe region. In some embodiments, upper 120 includes a heel counter 160 to provide additional support and/or protection to the wearer's foot in the heel region.

Athletic shoe 100 is further provided with an inflation system. The inflation system includes an inflatable bladder 200 operatively coupled to an inflation mechanism 240 and a release mechanism 250.

In some embodiments, athletic shoe 100 comprises inflatable bladder 200. Inflatable bladder 200 advantageously secures the wearer's foot in athletic shoe 100 and reduces heel slip, for example, by cinching down on the wearer's foot. In some embodiments, bladder 200 draws flexible layer 130 toward the wearer's foot when bladder 200 is inflated such that bladder 200 may tighten flexible layer 130 around the wearer's foot. In addition, utilizing inflatable bladder 200 in athletic shoe 100 reduces the need for additional foam or other padding and pieces, thus providing an easier construction and manufacture of athletic shoe 100 compared to standard padded footwear.

Figure 7:
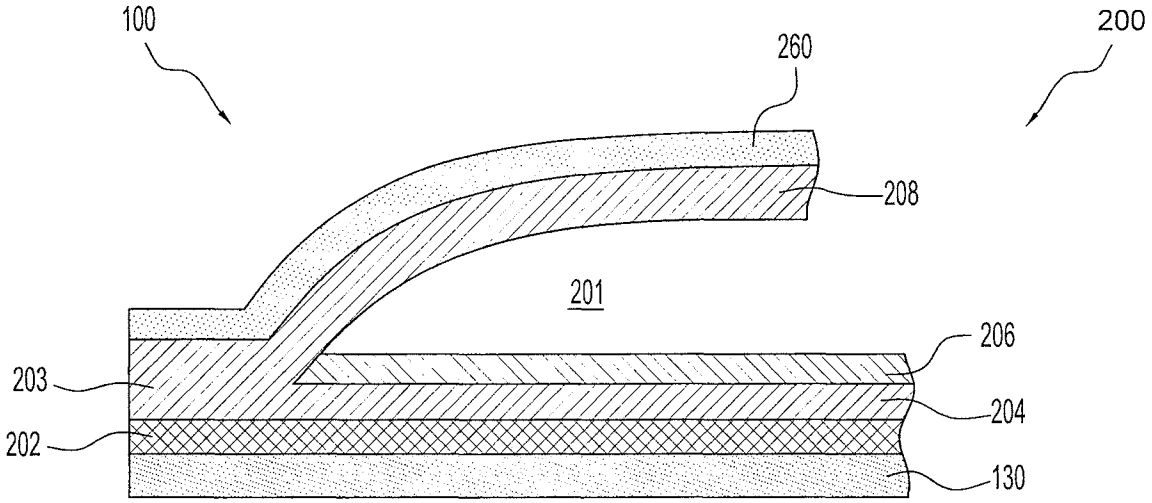
FIG. 7 shows a cross-sectional view of a bladder on an article of footwear according to some embodiments.

In some embodiments, inflatable bladder 200 is disposed on an outermost surface of upper 120. In some embodiments, inflatable bladder 200 is disposed on an outer surface of flexible layer 130. In some embodiments, inflatable bladder 200 is attached to upper 120 (e.g., flexible layer 130) by stitching, adhesive, bonding, heat sealing, or other suitable fastening means. For example, as shown in FIG. 7, bladder 200 may be hot melted to flexible layer 130 with an adhesive 202. In some embodiments, adhesive 202 may include, for example, an ethylene-vinyl acetate copolymer, a polyolefin, a polyamide, a polyester, a polyurethane, or other suitable adhesive. In some embodiments, as shown in FIG. 7, for example, bladder 200 may be hot melted to the outermost layer (i.e., outermost flexible layer 130) of upper 120. Thus, adhesive 202 forms a layer between flexible layer 130 and a first film 204 of bladder 200. The layers of bladder 200 shown in FIG. 7 will be discussed more fully below.

In some embodiments, bladder 200 forms a portion of the outermost layer of athletic shoe 100. In some embodiments, an additional layer 260 may be disposed on an outer surface of bladder 200. In some embodiments, additional layer 260 comprises a coating (e.g., a polyurethane coating). In some embodiments, additional layer 260 forms a portion of the outermost layer of athletic shoe 100, thus forming a portion of an exterior of upper 120. In some embodiments, additional layer 260, such as a polyurethane coating, may be provided to give athletic shoe a particular appearance. For example, additional layer 260 may provide a particular color or material or other marking to contribute to the look and feel of athletic shoe 100.

Other configurations of securing inflatable bladder 200 to other portions of upper 120 are also envisioned. For example, inflatable bladder 200 could be attached via RF welding, sonic welding, or other mechanical means.

Figure 2:
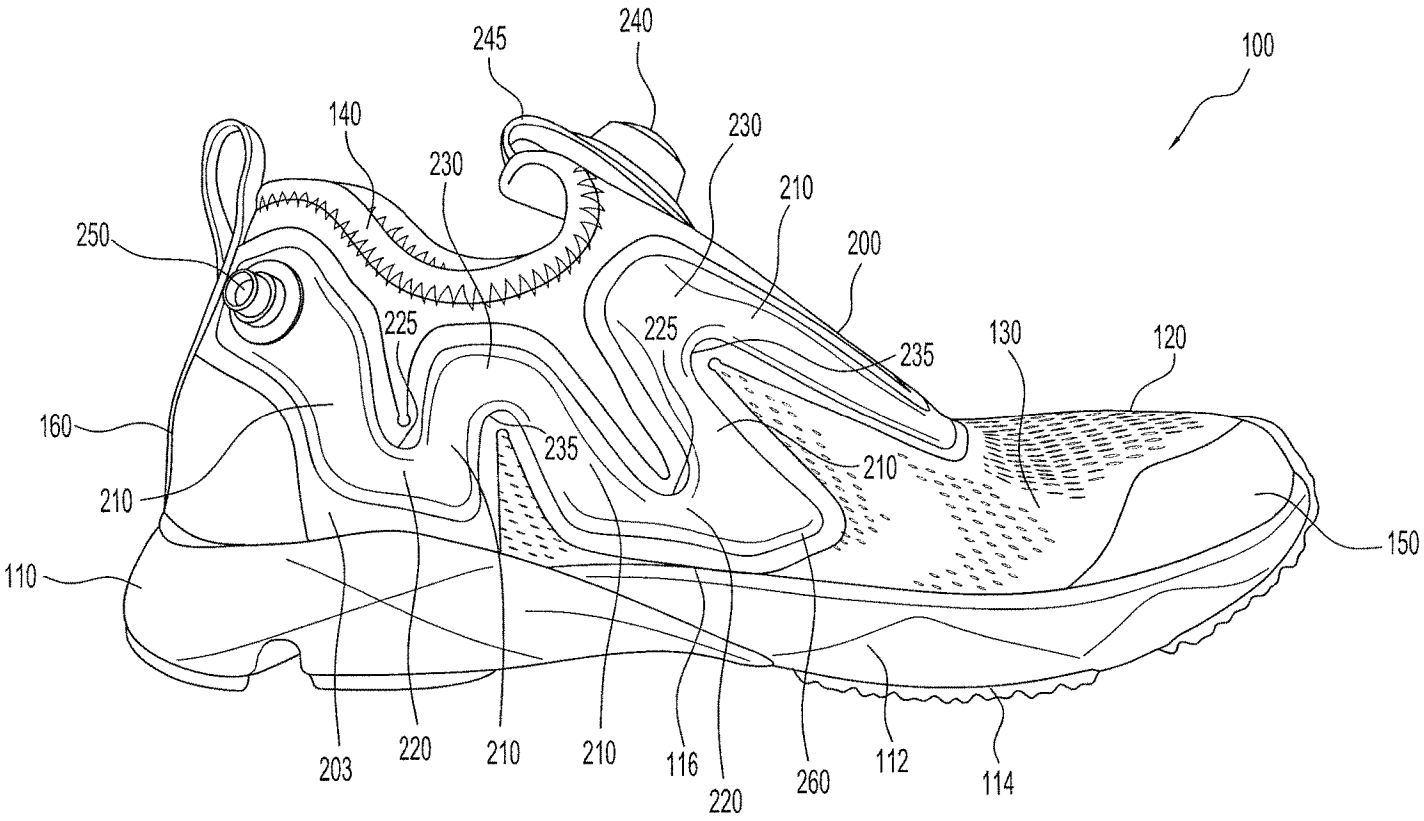
FIG. 2 shows a medial side view of an article of footwear according to some embodiments.
Figure 3:
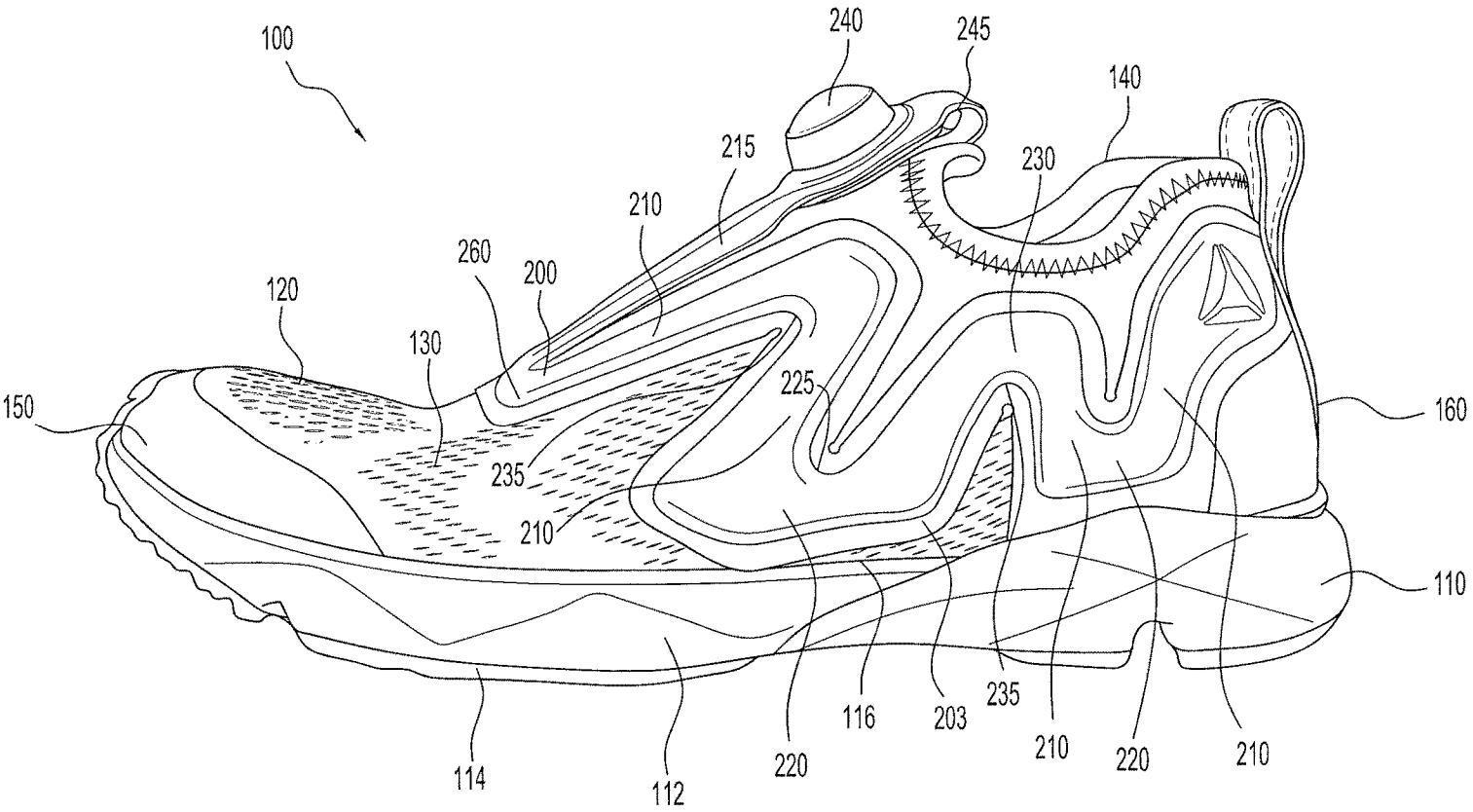
FIG. 3 shows a lateral side view of an article of footwear according to some embodiments.
Figure 4:
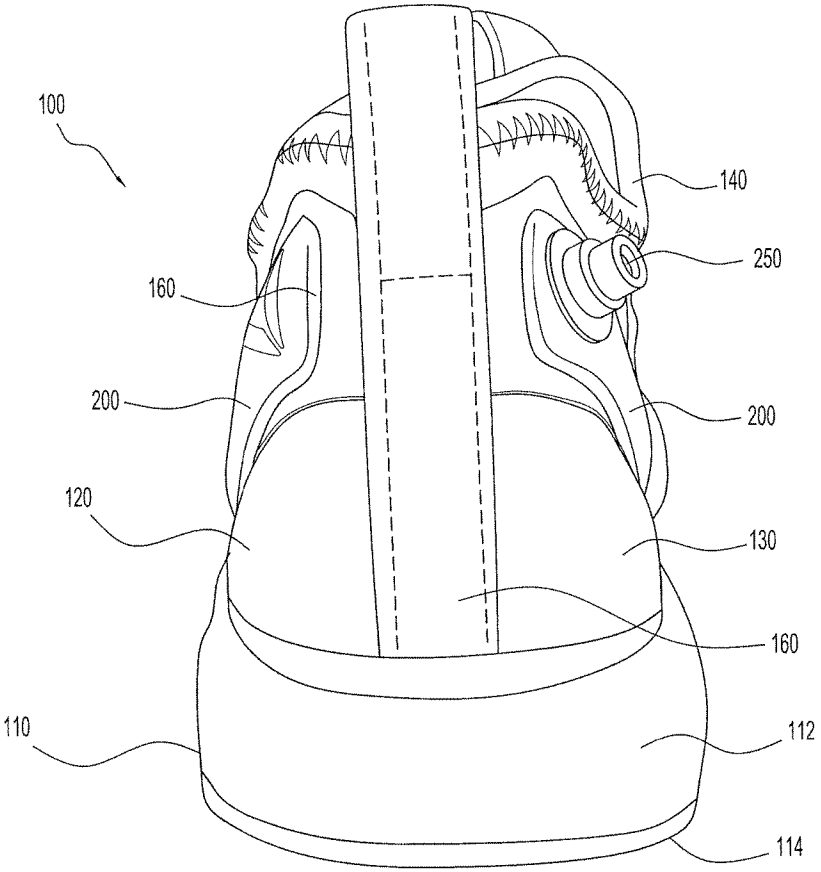
FIG. 4 shows a rear view of an article of footwear according to some embodiments.
Figure 5:
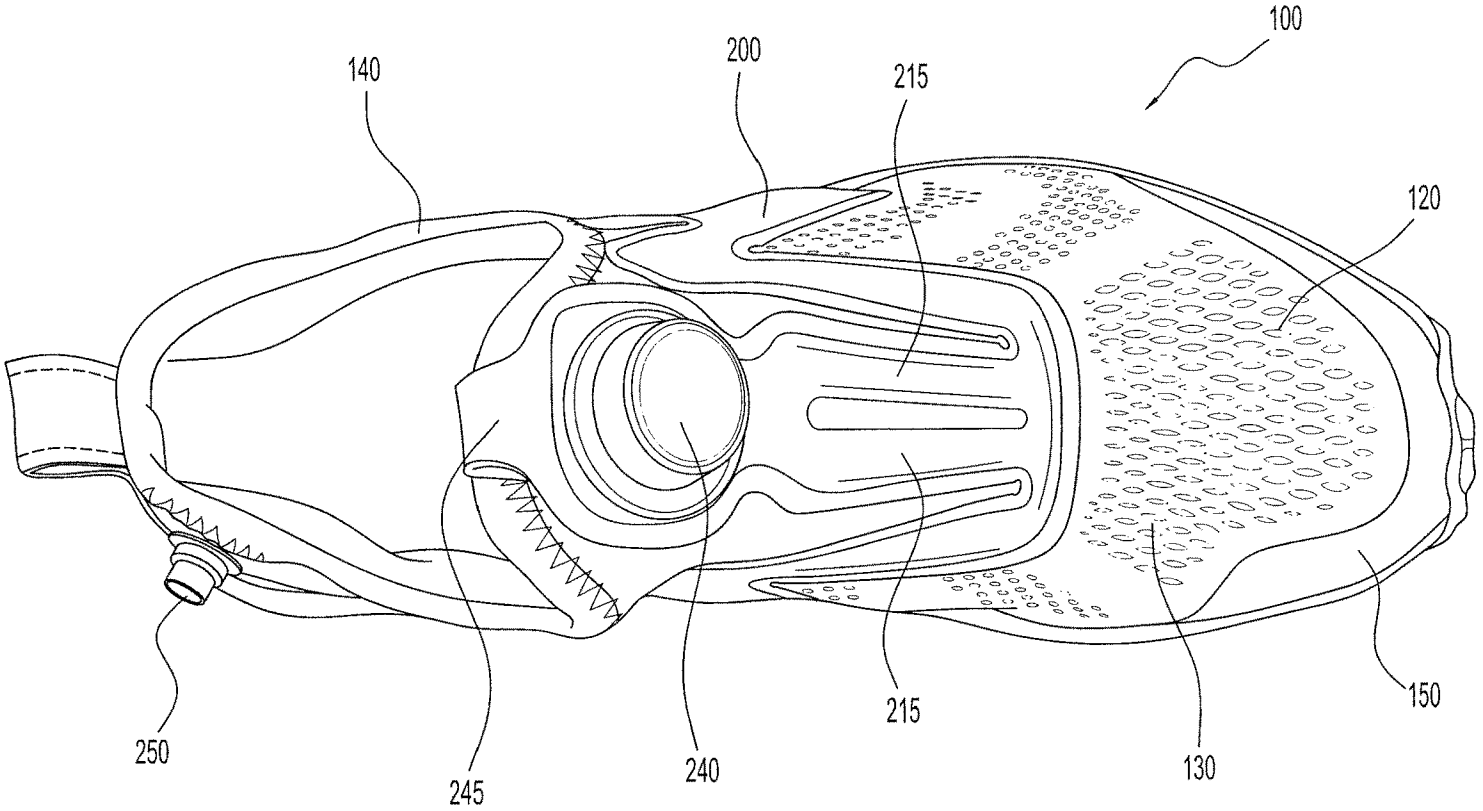
FIG. 5 shows a top view of an article of footwear according to some embodiments.
Figure 6:
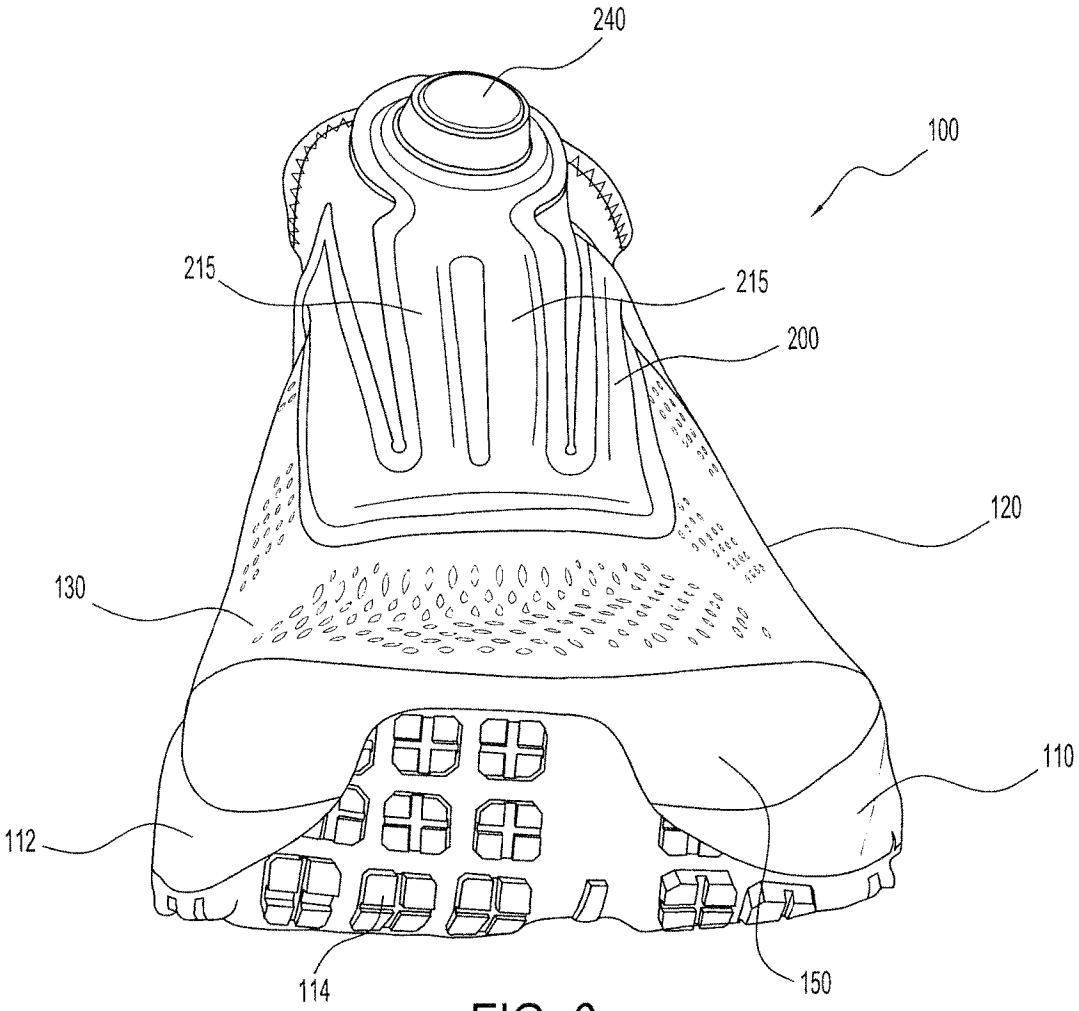
FIG. 6 shows a front view of an article of footwear according to some embodiments.

In some embodiments, bladder 200 extends from a lateral side in a heel region across a throat region to a medial side in the heel region, as shown, for example, in FIGS. 1-6. In some embodiments, bladder 200 includes a plurality of fluidly connected segments 210. In some embodiments, segments 210 are fluidly connected by lower joints 220 and upper joints 230. In some embodiments, segments 210 are drawn closer to each other when bladder 200 is inflated, thus compressing bladder 200 around the wearer's foot. In some embodiments, as segments 210 are drawn closer to each other, bladder 200 tightens around the wearer's foot. In some embodiments, bladder 200 comprises a single fluidly connected inflatable compartment 201 (see FIG. 7) that extends from the lateral side in the heel region across the throat region to the medial side in the heel region. In some embodiments, bladder 200 forms a conduit (i.e., inflatable compartment 201 comprises a conduit). In some embodiments, there is a break in the heel region between the lateral side and the medial side (i.e., no fluid connection), for example, at heel counter 160, as shown in FIG. 4. In some embodiments, there is no break in the heel region such that inflatable compartment 201 completely surrounds athletic shoe 100 below collar 140.

In some embodiments, bladder 200 forms a zig-zag pattern on upper 120. In some embodiments, the zig-zag pattern is a vertical zig-zag pattern. For example, segments 210 of bladder 200 may extend between collar 140 and sole 110 on the medial side and the lateral side of athletic shoe 100, as shown, for example, in FIGS. 2 and 3. In some embodiments, segments 210 extend away from collar 140 in a throat region towards a vamp region of athletic shoe 100, as shown, for example, in FIGS. 5 and 6. In some embodiments, segments 210 in the throat region are forked passages 215. The forked passages 215 may lead up to inflation mechanism 240. In some embodiments, forked passages 215 deliver air as it being pumped through inflation mechanism 240 to other portions of bladder 200. In some embodiments, forked passages 215 are fluidly connected at the top (near collar 140 where inflation mechanism 240 may be disposed) and the bottom (near the vamp section of upper 120) of the throat region.

In some embodiments, each segment 210 forms an angle with an adjacent segment 210. In some embodiments, the angle between adjacent segments 210 may be between 0 and 180 degrees. In some embodiments, the angle between adjacent segments 210 may be less than 90 degrees. In some embodiments, the angle between adjacent segments 210 may be less than 45 degrees. For example, the angle between adjacent segments 210 may be about 10, 15, 20, 25, 30, or 45 degrees. In some embodiments, the angle between each pair of adjacent segments 210 may be the same. In some embodiments, the angle between one pair of adjacent segments 210 may differ from the angle between another pair of adjacent segments 210. In some embodiments, the angle between adjacent segments 210 at inner side 235 is greater than the angle between adjacent segments 210 at inner side 225.

In some embodiments, two adjacent segments 210 form a V shape. Two adjacent segments 210 fluidly connected by a lower joint 220 may form a V shape. Two adjacent segments 210 fluidly connected by an upper joint 230 may form an inverted V shape. In some embodiments, lower joint 220 comprises an inner side 225. In some embodiments, inner side 225 is a curved portion of a zig-zag pattern. In some embodiments, inner side 225 is circular. In some embodiments, inner side 225 approximates a square. Inner side 225 may also approximate other shapes, such as a triangle or oval. In some embodiments, upper joint 230 comprises an inner side 235. In some embodiments, inner side 235 is a curved portion of a zig-zag pattern. In some embodiments, inner side 235 is circular. In some embodiments, inner side 235 approximates a square. Inner side 235 may also approximate other shapes, such as a triangle or oval.

In some embodiments, lower joint 220 runs along a length of sole 110, as shown, for example, in FIGS. 2 and 3. For example, lower joint 220 may run along a length of an upper edge 116 of sole 110. In some embodiments, the two fluidly connected adjacent segments 210 extend inwardly and upwardly along the outer surface of flexible layer 130. For example, the two fluidly connected adjacent segments 20 may extend toward the collar 140 or throat of upper 120. This configuration may contribute to the cinching action of bladder 200 when bladder 200 is inflated.

In some embodiments, lower joint 220 is disposed in a midfoot portion of upper 120. In some embodiments, lower joint 220 is disposed adjacent to the upper edge 116 of sole 110 in a midfoot portion. For example, in some embodiments, a portion of peripheral edge 203 abuts the upper edge 116 of sole 110 in a midfoot portion of upper 120. In some embodiments, lower joint 220 is disposed near a heel of upper 120. In some embodiments, lower joint 220 is disposed adjacent to the upper edge 116 of sole 110 near the heel. For example, in some embodiments, a portion of peripheral edge 203 abuts the upper edge 116 of sole 110 near the heel of upper 120.

In some embodiments, lower joint 220 runs along a length of sole 110 such that lower joint 220 is substantially parallel to upper edge 116 of sole 110. In some embodiments, lower joint 220 ends rearward of the front of bladder 200. In some embodiments, the forward segment 210 of the two adjacent segments 210 fluidly connected by lower joint 210 extends upward and rearward along the outer surface of flexible layer 130. In some embodiments, each lower joint 220 is disposed lower on upper 120 than each upper joint 230 (i.e., the top of lower joints 220 are all lower than the bottom of all upper joints 230).

Figure 8:
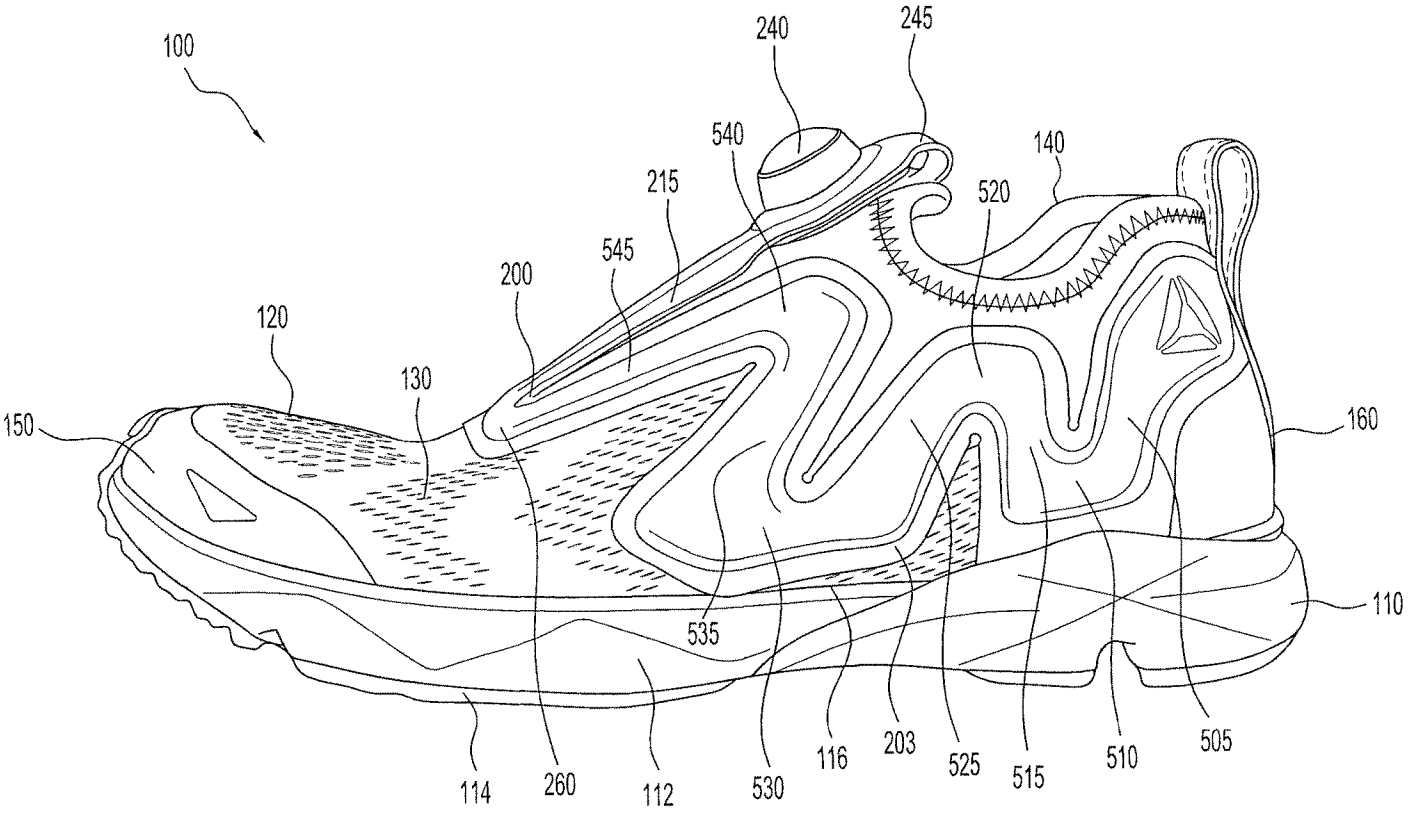
FIG. 8 shows a lateral side view of an article of footwear according to some embodiments.

Portions of bladder 200 will now be described with reference to FIGS. 8 and 9. In some embodiments, bladder 200 includes a first lateral segment 505. In some embodiments, first lateral segment 505 is disposed in a heel region. An end of first lateral segment 505 is disposed near collar 140 and heel counter 160. In some embodiments, the end of first lateral segment 505 is an end of the conduit formed by bladder 200. In some embodiments, a top portion of the end of first lateral segment 505 has a shape that follows the contour of collar 140. In some embodiments, first lateral segment 505 extends downwardly and forwardly to first lateral lower joint 510.

In some embodiments, first lateral lower joint 510 runs along a length of sole 110 near the heel of upper 120. In some embodiments, first lateral lower joint 510 is substantially parallel to the upper edge 116 of sole 110. In some embodiments, a portion of peripheral edge 203 at first lateral lower joint 510 abuts the upper edge 116 of sole 110. In some embodiments, first lateral lower joint 510 extends from first lateral segment 505 to a second lateral segment 515.

In some embodiments, second lateral segment 515 extends upwardly along the outer surface of flexible layer 130. In some embodiments, second lateral segment 515 extends only upwardly. In some embodiments, second lateral segment 515 extends upwardly and forwardly. In some embodiments, second lateral segment 515 extends perpendicular to collar 140. In some embodiments, second lateral segment 515 extends from first lateral lower joint 510 near sole 110 to first lateral upper joint 520 near collar 140.

In some embodiments, first lateral upper joint 520 extends forwardly along the outer surface of flexible layer 130. In some embodiments, first lateral upper joint 520 extends substantially parallel to the nearest portion of collar 140. In some embodiments, first lateral upper joint 520 follows the contour of collar 140. In some embodiments, first lateral upper joint 520 is disposed lower on upper 120 than the end of first lateral segment 505. In some embodiments, first lateral upper joint 520 extends from second lateral segment 515 to a third lateral segment 525.

In some embodiments, third lateral segment 525 extends downwardly and forwardly along the outer surface of flexible layer 130. In some embodiments, third lateral segment 525 extends from near collar 140 to near sole 110. In some embodiments, the end of third lateral segment 525 near sole 110 is disposed forward of collar 140. In some embodiments, third lateral segment 525 extends from first lateral upper joint 520 to a second lateral lower joint 530.

In some embodiments, second lateral lower joint 530 runs along a length of sole 110 in a midfoot portion of upper 120. In some embodiments, second lateral lower joint 530 is substantially parallel to the upper edge 116 of sole 110. In some embodiments, a portion of peripheral edge 203 at second lateral lower joint 530 abuts the upper edge 116 of sole 110. In some embodiments, second lateral lower joint 530 appears to be a continuation of first lateral lower joint 510, but with a gap between first lateral lower joint 510 and second lateral lower joint 530. In some embodiments, second lateral lower joint 530 ends rearward of the front of bladder 200. In some embodiments, second lateral lower joint 530 extends from third lateral segment 525 to a fourth lateral segment 535.

In some embodiments, fourth lateral segment 535 extends upwardly and rearwardly along the outer surface of flexible layer 130. In some embodiments, fourth lateral segment 535 extends towards collar 140. In some embodiments, fourth lateral segment 535 extends from near sole 110 to near collar 140. In some embodiments, fourth lateral segment 535 extends from second lateral lower joint 530 to a second lateral upper joint 540.

In some embodiments, second lateral upper joint 540 extends forwardly and upwardly along the outer surface of flexible layer 130. In some embodiments, second lateral upper joint 540 extends parallel to the nearest portion of collar 140. In some embodiments, second lateral upper joint 540 is not parallel with first lateral upper joint 520. In some embodiments, second lateral upper joint 540 is disposed higher on upper 120 than first lateral upper joint 520 and substantially even with the end of first lateral segment 505. In some embodiments, second lateral upper joint 540, first lateral upper joint 520, and the end of first lateral segment 505 together follow the contour of collar 140, but with gaps between second lateral upper joint 540 and first lateral upper joint 520 and between first lateral upper joint 520 and the end of first lateral segment 505. In some embodiments, second lateral upper joint 540 extends from fourth lateral segment 535 to a fifth lateral segment 545.

In some embodiments, fifth lateral segment 545 extends forwardly and downwardly along the outer surface of flexible layer 130. For example, fifth lateral segment 545 extends towards toe cap 150. In some embodiments, fifth lateral segment 545 is substantially parallel to forked passages 215. In some embodiments, the angle between fourth lateral segment 535 and fifth lateral segment 545 is greater than the angle between any other pair of lateral segments. In some embodiments, fifth lateral segment 545 extends from second lateral upper joint 540 to the front of bladder 200.

In some embodiments, the front of bladder 200 extends across the throat and/or vamp section of upper 120. Forked passages 215 extend from the front of bladder 200 to inflation mechanism 240. In some embodiments, the medial side of bladder 200 is different than the lateral side of bladder 200. In some embodiments, the medial side of bladder 200 is the same as the lateral side of bladder 200.

Figure 9:
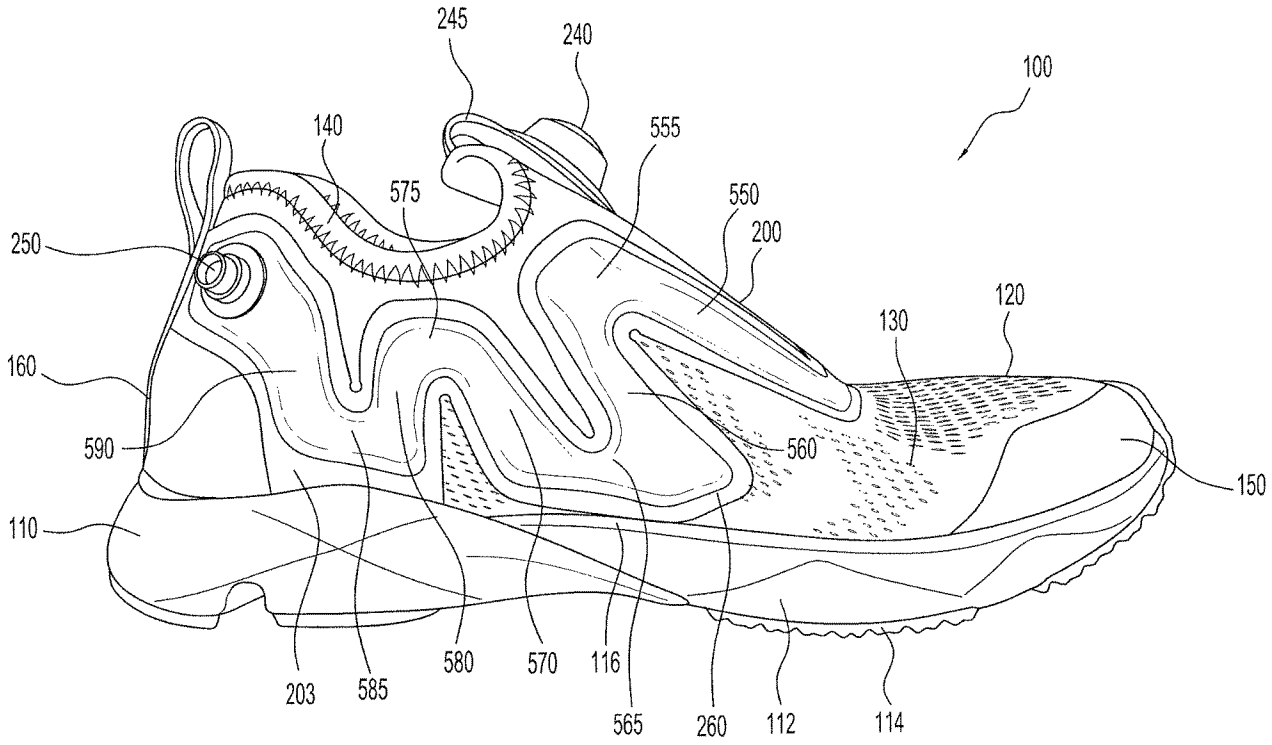
FIG. 9 shows a medial side view of an article of footwear according to some embodiments.
Figure 10:
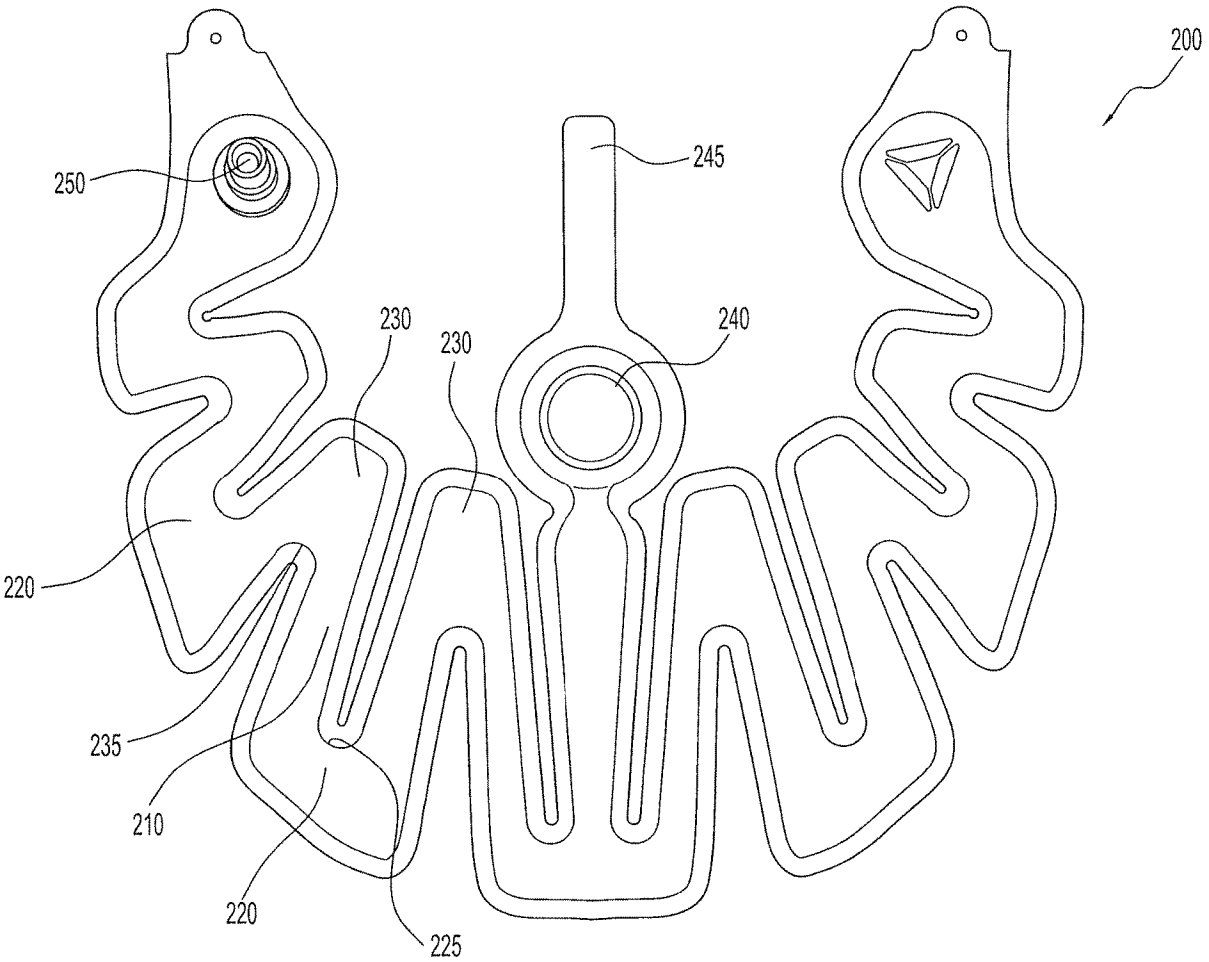
FIG. 10 shows a bladder for an article of footwear in a deflated state according to some embodiments.
Figure 11:
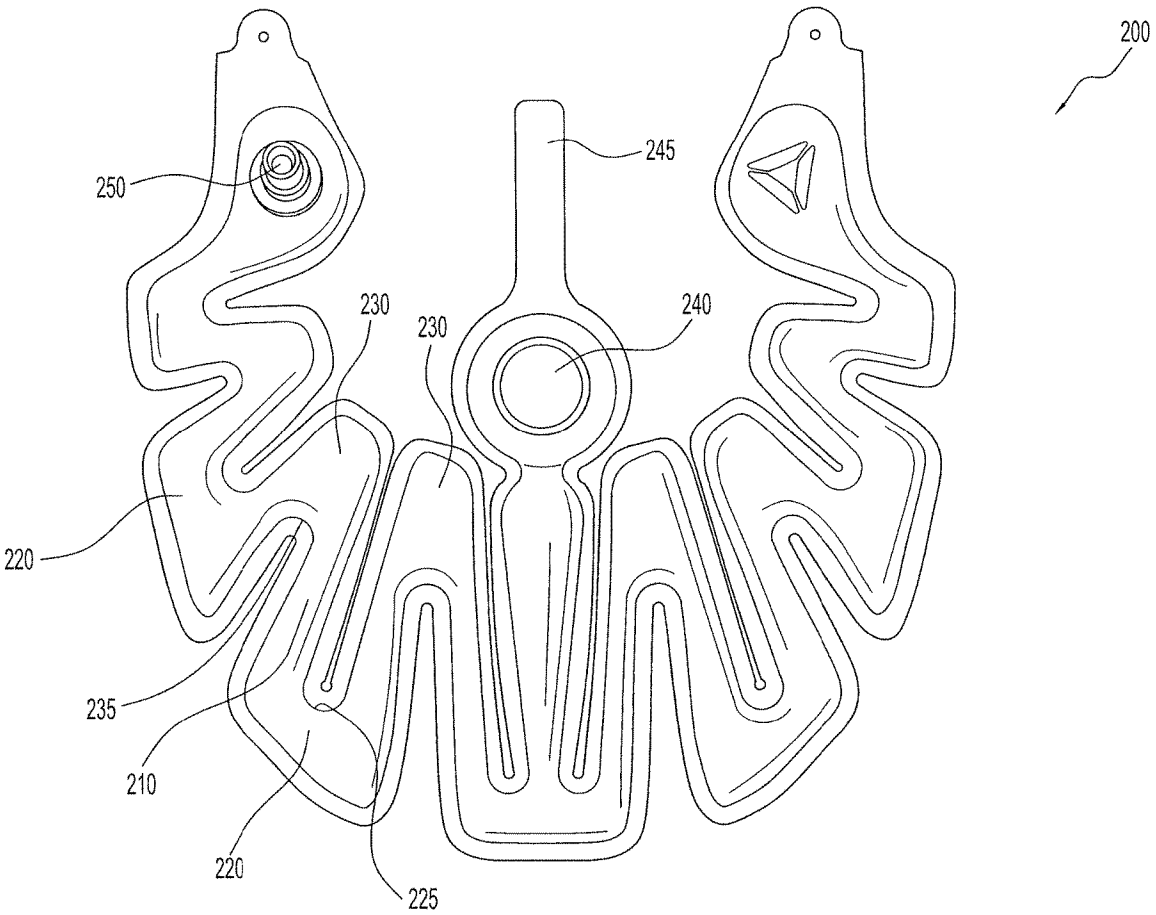
FIG. 11 shows a bladder for an article of footwear in an inflated state according to some embodiments.

Thus, as shown in FIG. 9, for example, bladder 200 may have a first medial segment 590 that mirrors first lateral segment 505, a first medial lower joint 585 that mirrors first lateral lower joint 510, a second medial segment 580 that mirrors second lateral segment 515, a first medial upper joint 575 that mirrors first lateral upper joint 520, a third medial segment 570 that mirrors third lateral segment 525, a second medial lower joint 565 that mirrors second lateral lower joint 530, a fourth lateral segment 560 that mirrors fourth lateral segment 535, a second medial upper joint 555 that mirrors second lateral upper joint 540, and/or a fifth medial segment 550 that mirrors fifth lateral segment 545. In some embodiments, release mechanism 250 is disposed in an end of first medial segment 590. In some embodiments, first lateral segment 505 and first medial segment 590 surround and provide support to the Achilles tendon of a wearer's foot In some embodiments, when bladder 200 is in an inflated state, air disposed in a bottom portion of bladder 200 (i.e., air in lower joint 220 and lower portions of segments 210 near lower joint 220) causes a top portion of bladder 200 to tighten or cinch down around the wearer's foot. In some embodiments, when bladder 200 is in an inflated state, air disposed in a top portion of bladder 200 (i.e., air in upper joint 230 and upper portions of segments 210 near upper joint 230) causes a bottom portion of bladder 200 to tighten or cinch down around the wearer's foot. The bottom portion of bladder 200 is a portion of bladder 200 that is closer to sole 110, while a top portion of bladder 200 is a portion of bladder 200 that is closer to collar 140 of upper 120. The operation of bladder 200 can be seen, for example, in FIGS. 10 and 11. FIG. 10 shows bladder 200 in a deflated state and FIG. 11 shows bladder 200 in an inflated state. Inflated bladder 200 brings joints 230 and joints 220 closer together than deflated bladder 200. When bladder 200 is disposed on upper 120, this change cinches upper 120 down on the wearer's foot by constraining flexible layer 130 to a smaller circumference formed by upper joints 220. In some embodiments, rather than simply filling in empty space in upper 120, bladder 200 actually constricts flexible layer 130. Thus, when bladder 200 is inflated, bladder 200 securely fits athletic shoe 100 to the wearer's foot.

Any suitable type or shape of bladder suitable for footwear may be utilized within the scope of the present invention as inflatable bladder 200. In some embodiments, inflatable bladder 200 is a printed bladder as is described in commonly owned U.S. Pat. No. 8,572,786, entitled "Method for Manufacturing Inflatable Bladders for Use in Footwear and Other Articles of Manufacture," the disclosure of which is incorporated herein by reference thereto.

For example, according to some embodiments, inflatable bladder 200, as illustrated in FIG. 7, has a first film 204 and a second film 208. Disposed between first film 204 and second film 208 is a release agent 206. Release agent 206 may be disposed in a pattern that will correspond to a pattern of inflatable bladder 200 (e.g., a zig-zag pattern) formed by the following method.

According to some embodiments, release agent 206 is disposed on first film 204. Alternatively, release agent 206 may be disposed on both first film 204 and second film 208. First film 204 and second film 208 may be identical or different materials; but they must be each made from a material that may be adhered together to form a fluid-tight seal. Films can be formed from a variety of polymers such as thermoplastic resins, other elastomeric materials, thermoset materials, and composites thereof, including but not limited to, thermoplastic polyurethane (TPU), ethylenevinylacetate/polyethylene copolymer, polyester elastomer (e.g. Hytrel® material available from DuPont), polyethylene, polypropylene, neoprene, natural rubber, dacron/polyester, polyvinylchloride, thermoplastic rubbers, nitrile rubber, butyl rubber, sulfide rubber, methyl rubber, silicone rubber, polyvinyl acetate, Buna-N, Buna-S, polystyrene, ethylene propylene, polybutadiene, chlorfulfonated polythylene, nylon, partially set thermoset materials, ethylene vinyl acetate (EVA) foam, thermoset rubber, prepreg, and others.

Release agent 206 can be formed from a variety of materials, such as paint, ink, paper, textile, particulate, photosensitive agent, TEFLON®, silicone, plastic, acid, or any other material suitable for preventing first film 204 and second film 208 from adhering to each other where the release agent 206 has been disposed. In some embodiments, release agent 206 is cured to first film 204. For example, release agent 206 may be cured to first film 204 by the application of ultraviolet light. In some embodiments, release agent 206 may be silicone fortified.

After release agent 206 is applied to, disposed on, and/or cured to first film 204, first film 204 and second film 208 are bonded together by the application of heat and/or pressure. However, where release agent 206 is disposed between first film 204 and second film 208, there exists an inflatable compartment 201 with a peripheral edge 203. In some embodiments, this method may be used to create multiple inflatable compartments 201. The size, shape, and pattern of inflatable compartment 201 may vary from shoe to shoe to accommodate various needs and preferences.

In other embodiments, alternative methods of creating inflatable bladder 200 may be used.

Inflatable bladder 200 is operatively coupled to inflation mechanism 240. Inflation mechanism 240 may be located anywhere on athletic shoe 100. In some embodiments, inflation mechanism 240 is located in a throat region of athletic shoe 100. In some embodiments, inflation mechanism 240 is located on a tongue, or in a tongue region, of athletic shoe 100. In some embodiments, first film 204 of bladder 200 is not attached to upper 120 at the location of inflation mechanism 240 in the tongue region. Thus, inflation mechanism 240 may expand away from upper 120 when bladder 200 is inflated. In some embodiments, bladder 200 may include a tab 245 (as shown, for example, in FIGS. 1-3, 5, 10, and 11) disposed adjacent inflation mechanism 240 that folds around and attaches to upper 120 at collar 140, for example, by an adhesive or by sewing.

Inflation mechanism 240 may take many suitable forms. For example, in some embodiments, inflation mechanism 240 is an on-board pump. While in some embodiments inflation mechanism 240 is operated with a wearer's own hand or fingers, other embodiments require an external mechanism to operate inflation mechanism 240. Yet other embodiments provide inflation mechanism 240 that may be operated by either the wearer's hand or an external device.

In some embodiments, inflation mechanism 240 is an inflation mechanism as disclosed in commonly owned U.S. Pat. No. 5,435,230, entitled "Inflation Mechanism," the disclosure of which is incorporated herein by reference thereto.

Release mechanism 250 is also operatively coupled to inflatable bladder 200 and permits the wearer to release air that has been inflated into inflatable bladder 200. In some embodiments, release mechanism 250 is provided near inflation mechanism 240 (see FIG. 10). Release mechanism 250 is fitted within an aperture of inflatable bladder 200 to enable venting or deflation of the chamber. While release mechanism 250 may be located anywhere on inflatable bladder 200, it is preferable that release mechanism 250 be located where it can be conveniently activated by the wearer. In some embodiments, release mechanism 250 is located on the medial side of athletic shoe 100 below collar 140, as in FIG. 2.

Figure 12:
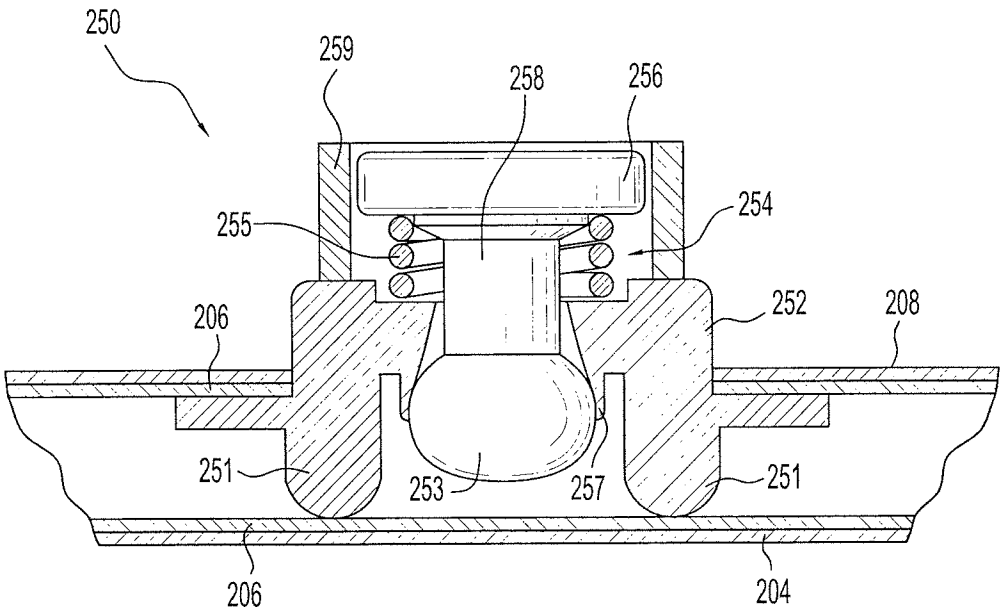
FIG. 12 shows a cross-sectional view of a release mechanism according to some embodiments.

In some embodiments, as shown, for example, in FIG. 12, release mechanism 250 generally includes a housing 252 and a fitting 254 for controlling the flow of fluid through the release mechanism. Housing 252 is preferably a molded thermal-polyurethane which may be easily attached (by RF welding, for example) to either first film 204 or second film 208 of inflatable bladder 200. At the bottom of housing 252, a plurality of extensions 251 are provided to prevent the opposing film (first film 204 or second film 208) of inflatable bladder 200 from interfering with operation of release mechanism 250.

Fitting 254 comprises a plunger 256 having a stem portion 258 and a stop member 253. A coil spring 255 is disposed about stem portion 258 of plunger 256 to bias fitting 254 in the closed position. As illustrated in FIG. 12, when plunger 256 is in the closed position, stop member 253 of plunger 256 abuts against an annular shoulder 257 of housing 252 to prevent leakage of air from inflatable bladder 200. Release mechanism 250 may also include, in some embodiments, a shoulder 259 that keeps plunger 256 from being prematurely activated. For example, shoulder 259 may be a part of housing 252. According to some embodiments, release mechanism 250 is a one-way film valve system that keeps air in the bladder.

Fitting 254 of release mechanism 250 may be made out of a number of materials including plastics, lightweight metals (such as aluminum) or any other material capable of being molded to a particular specification. Although one exemplary release mechanism 250 has been described, other suitable release mechanisms also exist and may be used in athletic shoe 100 within the scope of the present invention. For example, in some embodiments, the inflation and deflation mechanism are incorporated into the same component.

Various embodiments described herein afford the wearer with the capability to cinch down athletic shoe 100 to securely fit to the wearer's foot. After putting on athletic shoe 100, the wearer may use inflation mechanism 240 to inflate inflatable bladder 200 until athletic shoe 100 is securely fitted to the wearer's foot. After the wearer is done using athletic shoe 100, the wearer may use release mechanism 250 to deflate inflatable bladder 200 until the next use, making it easy to remove athletic shoe 100 from the wearer's foot.

Figure 13:
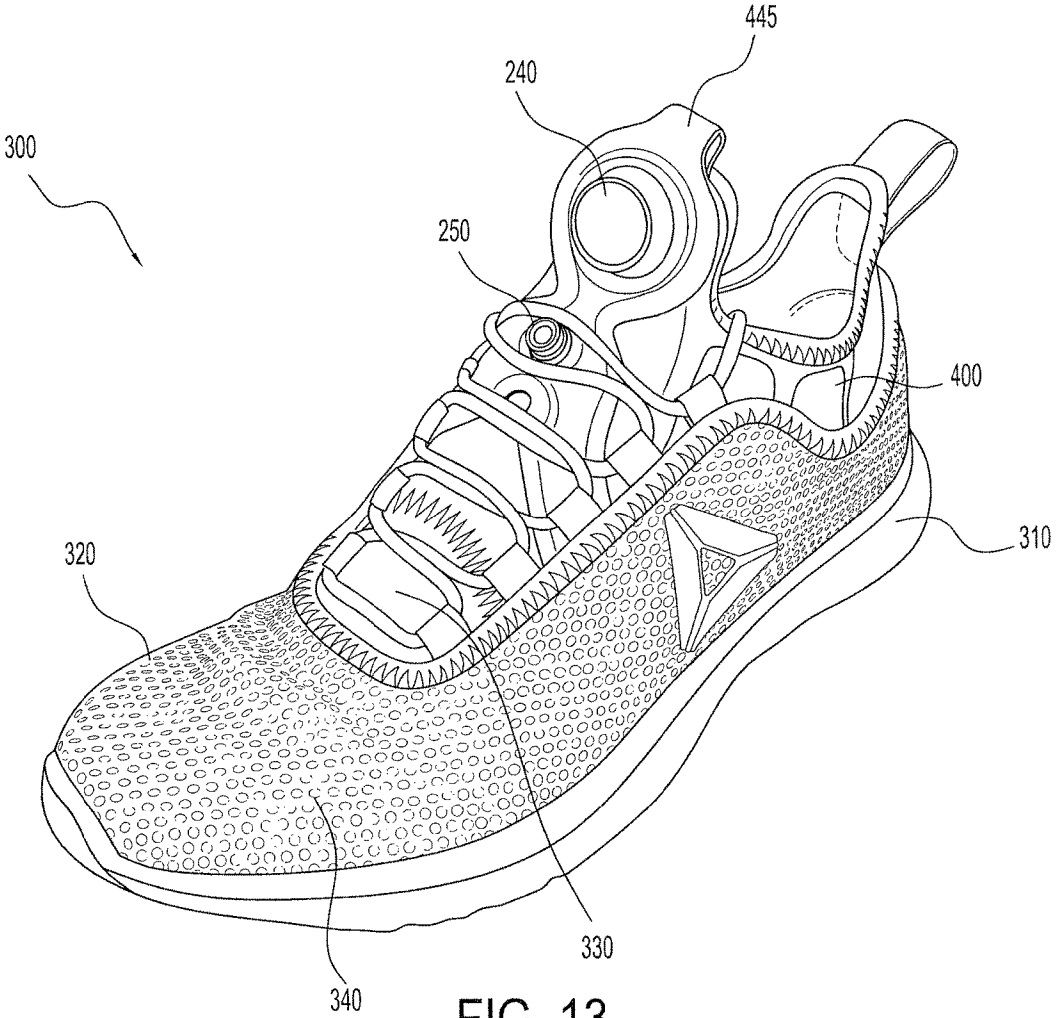
FIG. 13 shows a perspective view of an article of footwear according to some embodiments.

Further variations of the embodiments described above may also be provided. For example, in some embodiments, as shown in FIG. 13, an additional layer 340 may be disposed outside of a bladder 400. For example, in some embodiments, an athletic shoe 300 includes a sole 310 and an upper 320. Sole 310 may have similar features to those described above with respect to sole 210. Similarly, upper 320 may have similar features to those described above with respect to upper 220. However, in addition to one or more flexible layers 330, athletic shoe 300 may include additional layer 340 disposed outside of bladder 400. In some embodiments, additional layer 340 may comprise a mesh layer. In some embodiments, additional layer 340 (e.g., mesh layer) may include eyelets and shoelaces to further secure athletic shoe 300 to the wearer's foot.

Figure 14:
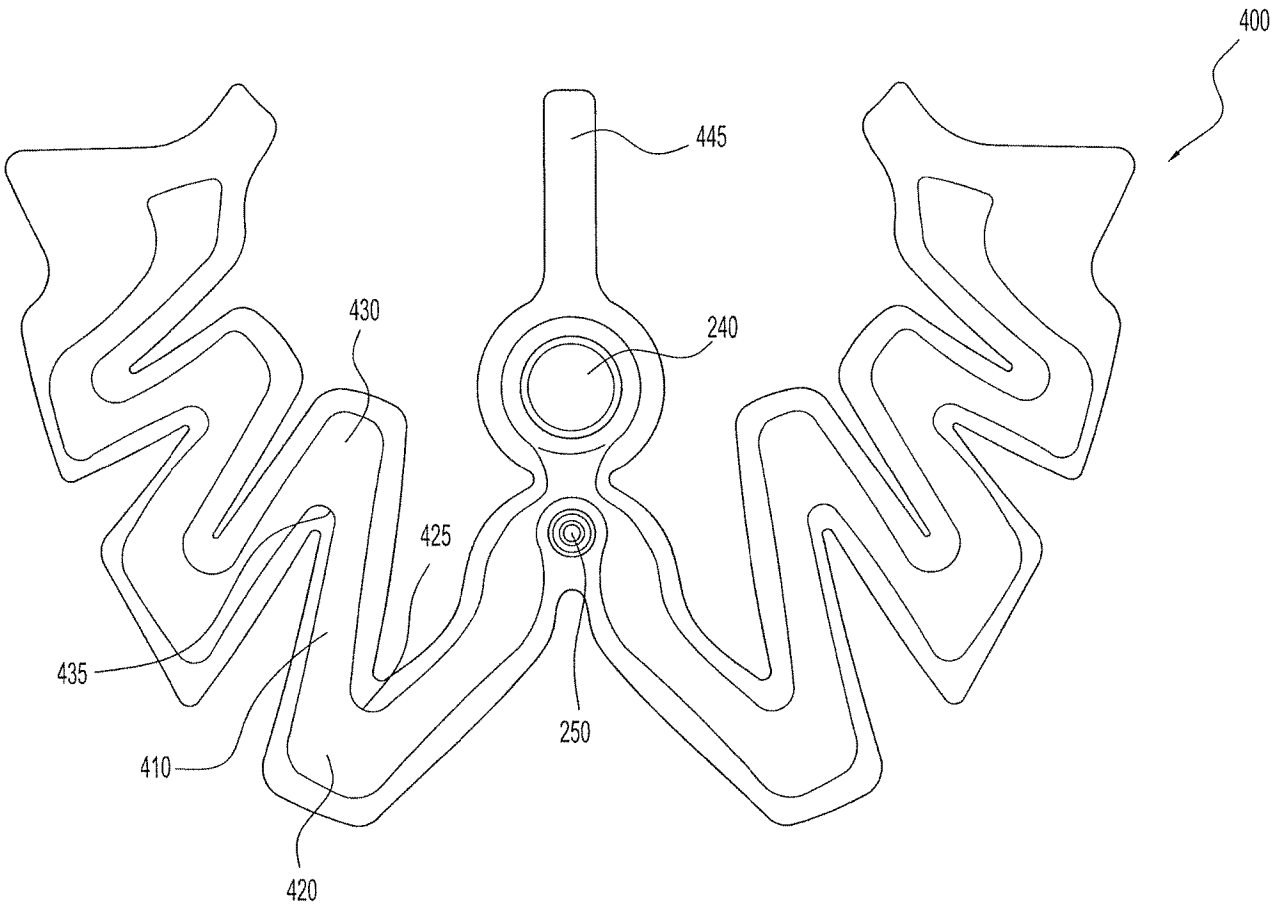
FIG. 14 shows a bladder for an article of footwear in a deflated state according to some embodiments.
Figure 15:
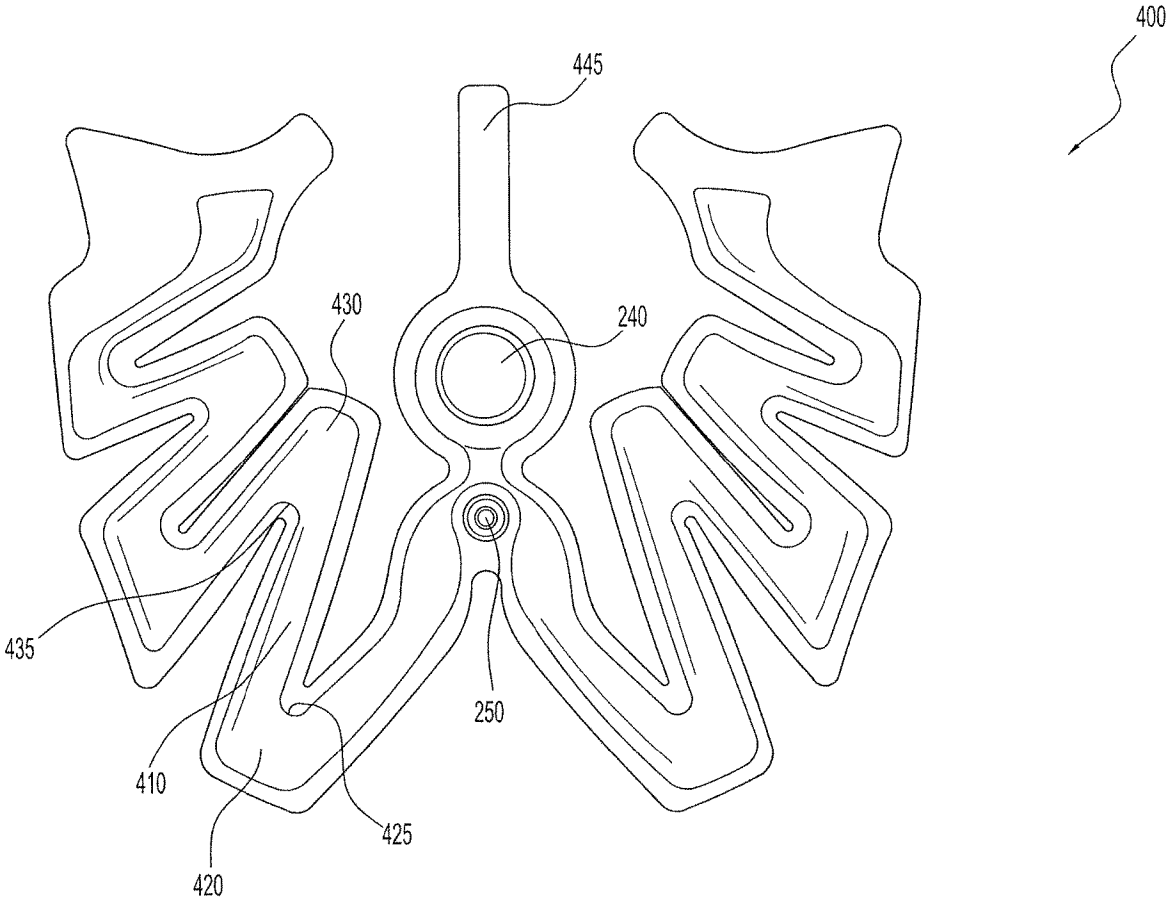
FIG. 15 shows a bladder for an article of footwear in an inflated state according to some embodiments.

In some embodiments, bladder 400 may have similar features as bladder 200, as shown, for example in FIGS. 13-15, including inflation mechanism 240, release mechanism 250, tab 445, segments 410, lower joint 420 including an inner side 425, and upper joint 430 including an inner side 435. In some embodiments, bladder 400 may differ from bladder 200 in some respects. For example, bladder 400 may have release mechanism 250 disposed in a throat region adjacent inflation mechanism 240. As an additional example, the portion of bladder 400 at the throat region that leads to inflation mechanism 240 may be configured such that the inflatable compartment of bladder 400 does not extend above the throat region in forked passages 215, as described above, but instead extends to the side of the throat region.

Further, even similar components may differ in dimensions. For example, a width of segments 410 may be different than a width of segments 210, an angle between adjacent segments 410 may be different than an angle between adjacent segments 210, and/or upper joint 430 may be a different shape than upper joint 230. These different dimensions may affect how upper 320 cinches down on the wearer's foot. For example, FIG. 14 shows bladder 400 in a deflated state and FIG. 15 shows bladder 400 in an inflated state. Inflated bladder 400 brings joints 430 and joints 420 closer together than deflated bladder 400. In addition, inflated bladder 400 makes a greater change compared to the change made by inflated bladder 200. When bladder 400 is disposed on upper 320, this change cinches upper 320 down on the wearer's foot. Thus, when bladder 400 is inflated, bladder 400 securely fits athletic shoe 300 to the wearer's foot.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An upper comprising:

a flexible layer configured to receive a foot;

a bladder coupled to an outer surface of the flexible layer, the bladder extending from a lateral side in a heel region across a throat region to a medial side in the heel region, the bladder comprising a plurality of fluidly connected segments, each segment forming an angle with an adjacent segment; and an inflation mechanism operatively coupled to the bladder for inflating the bladder such that the flexible layer is drawn toward the foot, wherein the plurality of fluidly connected segments comprises a first segment that extends downwardly and forwardly along the upper and a second segment adjacent the first segment, the second segment extending upwardly and rearwardly along the upper.

2. The upper of claim 1, wherein each of the plurality of fluidly connected segments extends away from a collar of the upper.

3. The upper of claim 1, wherein the angle is less than ninety degrees.

4. The upper of claim 1, wherein the angle is less than forty-five degrees.

5. The upper of claim 1, further comprising a joint fluidly connecting each segment, wherein an inner side of the joint is a partial circle.

6. The upper of claim 1, further comprising a joint fluidly connecting each segment, wherein an inner side of the joint approximates a partial square.

7. The upper of claim 1, wherein two adjacent segments form a V shape.

8. The upper of claim 1, further comprising a polyurethane coating overlaying the bladder and forming a portion of an exterior of the upper.

9. The upper of claim 1, wherein the bladder is coupled to the outer surface of the flexible layer by sewing.

10. The upper of claim 1, wherein the bladder is coupled to the outer surface of the flexible layer by hot melting.

11. The upper of claim 1, wherein the flexible layer comprises multiple layers.

12. The upper of claim 1, further comprising a release mechanism.

13. An article of footwear comprising:

a sole;

an upper attached to the sole and configured to receive a wearer's foot;

a bladder disposed on an outermost surface of the upper; and an inflation mechanism operatively coupled to the bladder, wherein the bladder forms a zig-zag pattern extending from a heel region on a lateral side across a throat region to the heel region on a medial side, wherein the zig-zag pattern of the bladder comprises at least three fluidly connected segments extending from a collar of the upper to the sole on the lateral side, and wherein in an inflated state, air disposed in a portion of the bladder closer to the sole causes a portion of the bladder closer to the collar of the upper to tighten around the wearer's foot.

14. The article of footwear of claim 13, wherein in an inflated state, air disposed in the portion of the bladder closer to the collar of the upper causes the portion of the bladder closer to the sole to tighten around the wearer's foot.

15. The article of footwear of claim 13, wherein the inflation mechanism is disposed at a top of the throat region.

16. The article of footwear of claim 13, further comprising a release mechanism.

17. The article of footwear of claim 13, further comprising a mesh layer partially surrounding the bladder.

18. The article of footwear of claim 13, wherein the bladder forms a conduit.

19. The article of footwear of claim 13, wherein the zig-zag pattern comprises a vertical zig-zag.

20. The article of footwear of claim 13, wherein an inner side of a curved portion of the zig-zag pattern is a partial circle.

21. The article of footwear of claim 13, wherein the portion of the bladder closer to the sole is disposed adjacent to the sole and extends horizontally along the sole.

* * * * *